US007281774B2

(12) United States Patent
Zenda et al.

(10) Patent No.: US 7,281,774 B2
(45) Date of Patent: Oct. 16, 2007

(54) OBJECT SUPPORTING UNIT

(75) Inventors: Youichi Zenda, Osaka (JP); Yoshimasa Kato, Osaka (JP); Hiromi Iwamuro, Osaka (JP); Shinya Noguchi, Osaka (JP)

(73) Assignee: Kokuyo Co., Ltd. (JP)

( * ) Notice: Subject to any disclaimer, the term of this patent is extended or adjusted under 35 U.S.C. 154(b) by 341 days.

(21) Appl. No.: 10/812,359

(22) Filed: Mar. 30, 2004

(65) Prior Publication Data

US 2005/0104491 A1 May 19, 2005

(30) Foreign Application Priority Data

Nov. 13, 2003 (JP) ..... P2003-420141

(51) Int. Cl.
*A47B 88/00* (2006.01)

(52) U.S. Cl. ..... 312/334.15; 312/334.39; 312/351.11

(58) Field of Classification Search ..... 312/235.1, 312/334.4, 334.27, 334.29, 334.31, 334.32, 312/334.33, 334.34, 334.36, 334.37, 334.39, 312/334.42, 334.43, 334.45, 201, 330.1, 312/334.46, 249.8, 249.9; 211/151, 162; 384/19; 104/106, 108, 110; 296/26.09, 296/26.03, 26.13

See application file for complete search history.

(56) References Cited

U.S. PATENT DOCUMENTS 827,649 A * 7/1906 Murphy ..... 312/301
1,281,923 A * 10/1918 Fales ..... 312/317.2
2,066,608 A * 1/1937 Bushnell ..... 312/29
2,327,761 A * 8/1943 Brodbeck ..... 312/334.15
2,739,864 A * 3/1956 Saunders ..... 312/306
2,950,158 A * 8/1960 Harmon ..... 312/334.14
3,259,432 A * 7/1966 Jackson ..... 297/354.1
3,613,566 A * 10/1971 Shapleigh et al. ..... 100/218
3,981,553 A * 9/1976 Gutner ..... 312/334.34
4,318,575 A * 3/1982 Redlich ..... 312/249.9
4,615,095 A * 10/1986 Bessinger et al. ..... 29/407.1

(Continued)

FOREIGN PATENT DOCUMENTS

DE 88 09 055 U1 9/1988

(Continued)

OTHER PUBLICATIONS

Patent Abstracts of Japan, vol. 1996, No. 02, Feb. 29, 1996 (for JP 07 255546 A of Okamura Corp.).

*Primary Examiner*—Jose V. Chen
*Assistant Examiner*—Matthew Ing
(74) *Attorney, Agent, or Firm*—Banner & Witcoff, Ltd.

(57) ABSTRACT

As an arrangement to reduce an operational force to draw the drawer 3 forward from the drawer storage position 2, wherein at least a rear end side of a drawer 3 is supported in a drawer storage portion 2 in a manner movable along back and forth and a front end 3*b* side thereof is supported in a manner movable along back and forth by a floor F at least through a rolling supporting body, the rolling supporting body adopts a free motion rotating body 12 whose upper end 12*b* makes an abutting contact with a downward facing surface 3*a* of the drawer 3 and whose bottom end 12*a* contacts the floor F and the free motion rotating body 12 supports the front end 3*b* side of the drawer 3 with making a rolling movement at a half traveling speed of the drawer 3.

8 Claims, 11 Drawing Sheets

U.S. PATENT DOCUMENTS 4,659,237 A * 4/1987 Rapp ..... 381/19
4,834,000 A * 5/1989 Darnell et al. ..... 108/57.15
4,861,122 A * 8/1989 Newhouse et al. ..... 312/330.1
5,046,790 A * 9/1991 Onomoto et al. ..... 312/351.13
5,680,942 A * 10/1997 McAllister et al. ..... 211/162
5,779,067 A * 7/1998 Reaney ..... 211/90.04
5,785,400 A * 7/1998 Grieser et al. ..... 312/334.12
6,371,584 B1 * 4/2002 Alreck ..... 312/235.1
6,457,790 B1 * 10/2002 Liang et al. ..... 312/334.46
2002/0043914 A1 * 4/2002 Munday et al. ..... 312/334.7

FOREIGN PATENT DOCUMENTS

EP 0 329 084 A 8/1989
EP 439774 * 8/1991
JP 2001-186946 1/2003

* cited by examiner

OBJECT SUPPORTING UNIT

FIELD OF THE INVENTION

This invention relates to an object supporting unit that makes it possible to operate a drawer of a desk with a drawer or a wagon or an object similar to this easily with little force.

BACKGROUND OF THE INVENTION

For example, drawers of a wagon are generally supported in a drawer storage portion as being a box body through a suspension rail mechanism or the like. Especially, since a great deal of goods is stored in a deep drawer locating at the lowest, a big load is applied to the drawer on a full-time basis.

In consideration of the above, a supporting unit to support this kind of a drawer adopts an arrangement as shown in a patent document 1 wherein at least a rear end side of a drawer is supported in a manner movable along back and forth in a drawer storage portion as being a box body through a suspension rail mechanism and a front end side thereof is supported in a manner movable along back and forth by a floor through an auxiliary wheel so as to prevent a front portion of the drawer from hanging down.

Patent Document 1: Patent Laid-Open No. 2001-186946

The auxiliary wheel is axially mounted on a bottom face at a center along a width of the front end side of the drawer through a bracket and moves at the same speed as that of the drawer. Since this kind of a conventional auxiliary wheel has an arrangement wherein an area that contacts with a floor is small with a relatively narrow width, friction between the auxiliary wheel and the floor increases, thereby requiring an excessive operational force especially for cases wherein the floor is soft or a load capacity of a drawer is big.

BRIEF SUMMARY OF THE INVENTION

The present claimed invention focuses attention on the above problems and intends to provide a new and useful object supporting unit that is useful for the purpose of operating an object such as a drawer of a desk with a drawer or a wagon with ease and little force.

In order to attain the above object the present claimed invention takes a following step.

The object supporting unit of the present claimed invention is so arranged that at least a rear end side of an object is supported in a box body in a manner movable along back and forth and a front end side thereof is supported in a manner movable along back and forth by a floor at least through a rolling supporting body so as to draw the object forward from a stored position in the box body, and is characterized by that the rolling supporting body adopts a free motion rotating body whose upper end makes an abutting contact with a downward facing surface of the object and whose bottom end contacts the floor, and the free motion rotating body supports the front end side of the object with making a rolling movement at a half traveling speed of the object.

Generally, in order to urge a rotating body against the frictional force between the rotating body and the floor, it is experientially recognized that the rotating body can be rolled with less force by urging a position near an upper end of the rotating body than a portion around the center of the rotating body and furthermore a position of the rotating body near the floor. As a result, if an operational force applied to the object when the object is drawn is transmitted from the downward facing surface to the upper end of the free motion rotating body like the present claimed invention, it is possible to move the object with less force compared with a case wherein the operational force is transmitted to an axis of an auxiliary wheel.

The free motion rotating body of the present claimed invention may be arranged to directly contact the downward facing surface of the object and the floor, which does not inhibit the free motion rotating body from being arranged to indirectly contact the downward facing surface of the object and the floor through an endless track.

In order to prevent the free motion rotating body from being separated from the object, it is preferable that the free motion rotating body is supported by the object in a manner capable of being suspended through a rail and a rotor.

In order to effectively prevent a front end side of the drawer from hanging down due to its weight during an operation to draw the drawer, it is effective that the free motion rotating body is supported at a position floating from the floor through the rail and the rotor at a time when the drawer is initially moved to draw out and the free motion rotating body gets into under an inclined face arranged on the downward facing surface of the object so as to lift the front end side of the object at a time after the free motion rotating body contacts the floor during an operation to draw the drawer.

In this case, it is preferable that a stopper is arranged at a part of the rail to hold the rotor tentatively at a front end portion of the rail until the free motion rotating body contacts the floor.

As an arrangement wherein the free motion rotating body is activated after the object is moved to a certain degree so as to shorten a distance that the free motion rotating body rotates on the floor as much as possible, it is effective to provide a guiding rotor and an inclined face to make the free motion rotating body float above the floor when the object initially moves and to make the free motion rotating body contact the floor after the object is moved to a predetermined position.

In order to make it possible to support the object by the free motion rotating body in consideration of supporting both side edges at the rear end side of the object with the rail mechanism, it is preferable that a width of the free motion rotating body exceeds one third of a width of the object and the free motion rotating body is arranged at a position supporting a middle portion along the width of the object.

As a preferable example to which the present claimed invention is applied represented is that the object is a drawer and the box body is a drawer storage portion of a desk with a drawer or store fixtures such as a wagon or the like equipped with a drawer.

The present claimed invention is especially useful if applied to the drawer that has an arrangement in which each upper part of three sides of a bottom wall is surrounded by a standing wall and an upper part of one side thereof that is orthogonal to a direction accessible to an article to be stored is open, in case that the drawer is a drawer to which a big load is applied such as a drawer arranged at the lowest part of the drawer storage portion or a simplical body arranged all over the drawer storage portion.

In accordance with the above-mentioned arrangement, the present claimed invention can provide an object supporting unit that makes it possible to operate various kinds of objects starting with a drawer attached to a desk with a drawer or a wagon at least whose rear end side is supported in a manner movable along back and forth in a box body with its front end side supported by a floor with a little force.

DETAILED DESCRIPTION OF THE INVENTION

One embodiment of the present claimed invention will be explained with reference to drawings.

Figure 1:
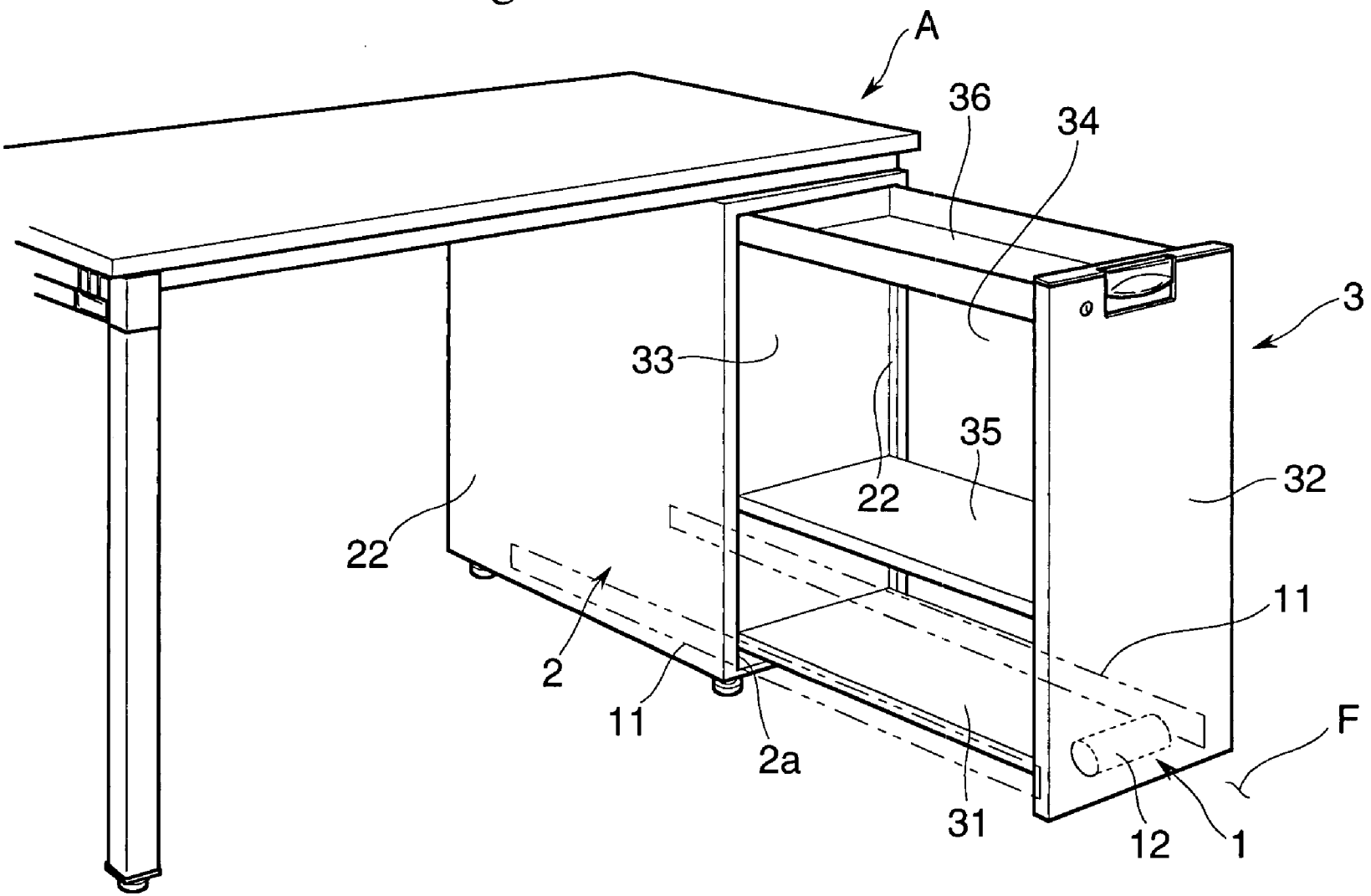
FIG. 1 is a perspective view showing a desk to which one embodiment of the present claimed invention is applied.

An object supporting unit 1 of the embodiment shown in FIG. 1 is so arranged that a drawer 3 as being an object is supported in a drawer storage portion 2 as being a box body constituting a desk A with a drawer in a manner that enables the drawer 3 to be drawn out or in.

The drawer storage portion 2 has an opening 2*a* at its front and a suspension rail mechanism 11 constituting a part of the object supporting unit 1 is arranged inside the opening 2*a*. The suspension rail mechanism 11 supports the drawer 3 from a rear end side in a manner that enables the drawer 3 to be drawn out or in between a position of FIG. 2 wherein the drawer 3 is generally completely stored in the drawer storage portion 2 and a position of FIG. 4 wherein the drawer 3 is mostly drawn out of the drawer storage portion 2 through a state of FIG. 3. The suspension rail mechanism 11 has a well-known arrangement comprising a proximal end rail 11*a*, a distal end rail 11*b* and a middle roller 11*c* as shown in pattern diagrams of FIG. 2 through FIG. 4 so as to draw the drawer 3 as much as possible with extending an arm telescopically, therefore an explanation will be omitted. A guide roller 21 (refer to FIG. 3 and FIG. 5) as being a guide rotor to support a downward facing surface 3*a* of a bottom wall 31 of the drawer 3 is arranged at an inner surface of a side wall near the opening 2*a* of the drawer storage portion 2.

The drawer 3 comprises a front wall 32, a rear wall 33 and a right side wall 34 each of which is an upright wall standing at three sides of the bottom wall 31 wherein an upper portion of a side that is orthogonal to a direction of drawing, more specifically, a portion corresponding to a left side wall is open so that a person can put on or take an article out of a shelf 35 or a tray 36 bridging the front wall 32, the rear wall 33 and the right side wall 34 from a side. The suspension rail mechanism 11 arranged in the drawer storage portion 2 supports at least right-and-left two places of the bottom wall 31 of the drawer 3 near the side wall 22 of the drawer storage portion 2 in a manner slidable along back and forth.

In this embodiment, a front end 3*b* side of the drawer 3 is supported in a manner movable along back and forth by a floor F through a free motion rotating body 12 as being a rolling supporting body.

The free motion rotating body 12 is a solid-core or hollow cylinder at least whose surface is made of resin with a diameter of 2r generally corresponding to a distance between the floor F and the downward facing surface 3*a* of the bottom wall 31 of the drawer 3 and with a width d exceeding one third of a width w of the drawer 3 and is arranged at a position supporting the downward facing surface 3*a* at a middle portion along a width direction of the front end 3*b* of the drawer 3 when the drawer 3 is stored in the drawer storage portion 2.

Figure 5:
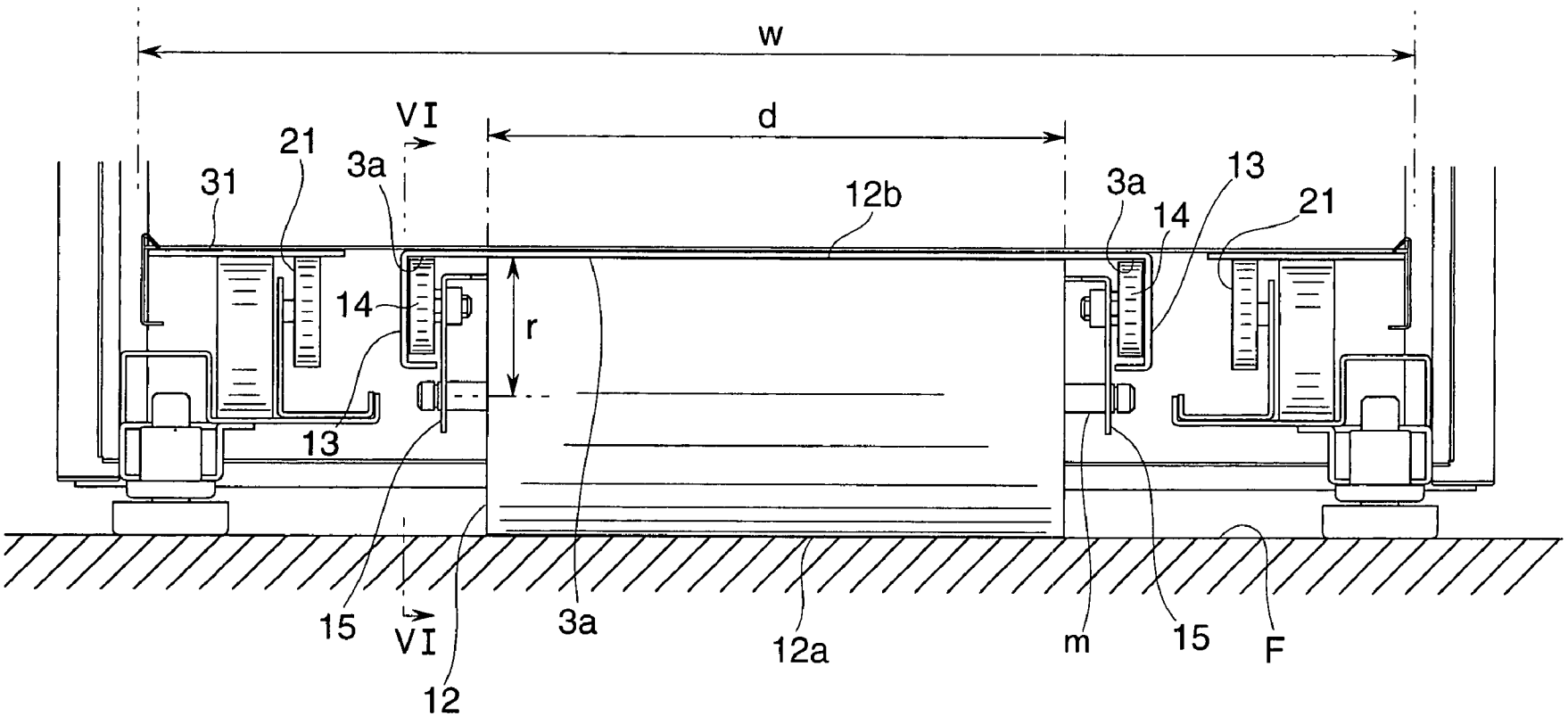
FIG. 5 is a magnified cross-sectional view taken along the line V-V in FIG. 3.
Figure 6:
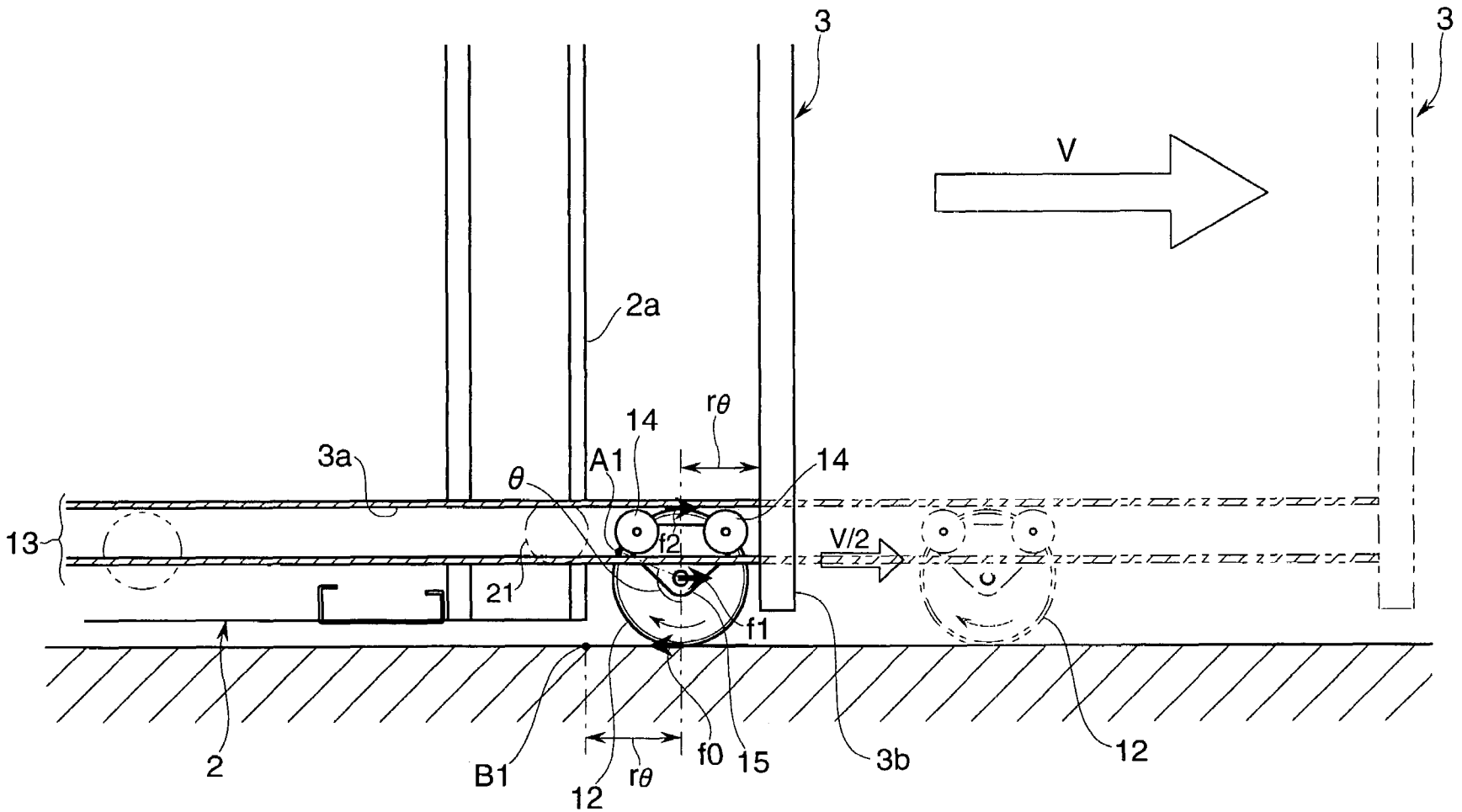
FIG. 6 is a cross-sectional view taken along the line VI-VI in FIG. 5.

More concretely, as shown in FIG. 5 and FIG. 6, a pair of channel shaped rails 13 are formed at right and left sides on the bottom face of the bottom wall 31 of the drawer 3 and a pair of inverse triangle brackets 15 are supported alongside by the rails 13 respectively through a pair of rotors 14. A pair of the brackets 15 are axially mounted on both ends of the free motion rotating body 12 through an axis m and a pair of the rotors 14 are arranged inner side of each rail 13 with a certain degree of clearance. More specifically, the rotors 14 are mounted on the rail 13 with some amount of clearance in a state wherein the lower end 12*a* of the free motion rotating body 12 contacts the floor F and its upper end 12*b* makes an abutting contact with the downward facing surface 3*a* of the drawer 3. Since the rotors 14 can make a rotational movement inside the rail 13 although the rotors 14 contact the rail 13, resistance to the rail 13 can be counted for nothing when the free motion rotating body 12 makes a movement relative to the drawer 3. A reason for adopting this arrangement is to attach the free motion rotating body 12 to the drawer 3 so as not to be detached therefrom by supporting the free motion rotating body 12 in a state capable of being suspended by the drawer 3 through the rails 13 and the rotors 14 when carrying the desk A.

Figure 2:
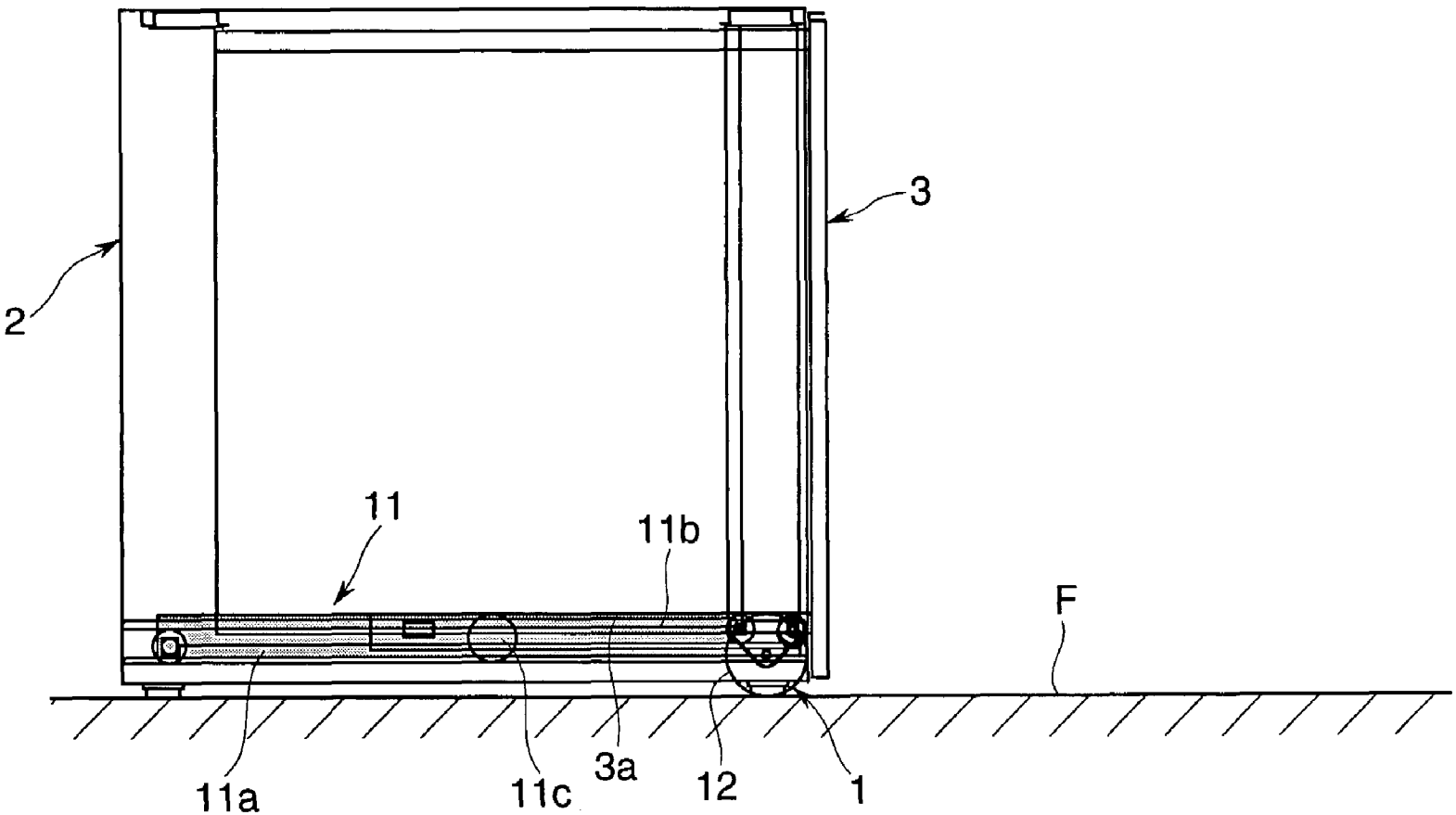
FIG. 2 is a pattern diagram showing a supporting arrangement of a drawer in accordance with the embodiment.
Figure 3:
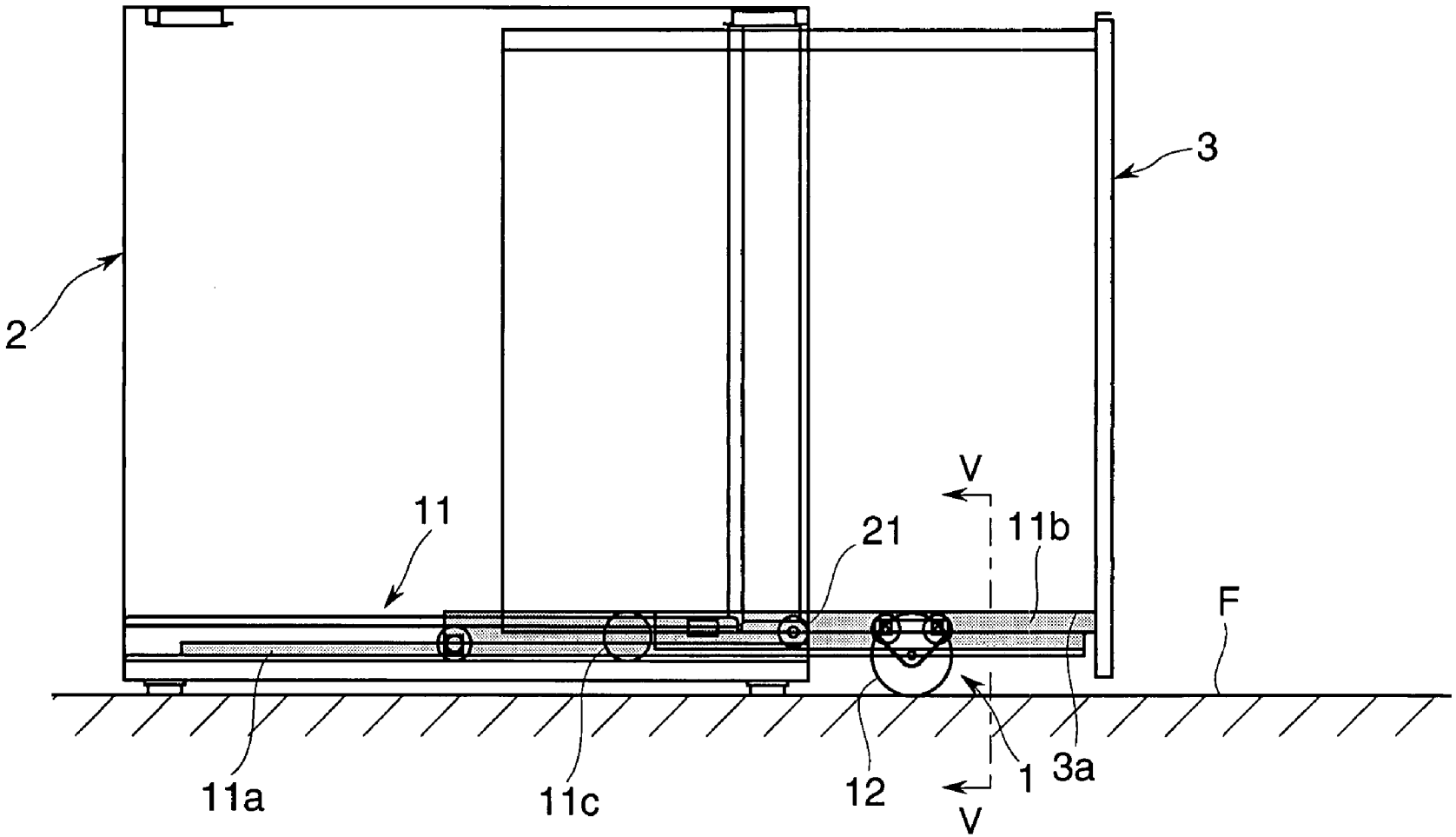
FIG. 3 is a pattern diagram showing the supporting arrangement of a drawer in accordance with the embodiment.
Figure 4:
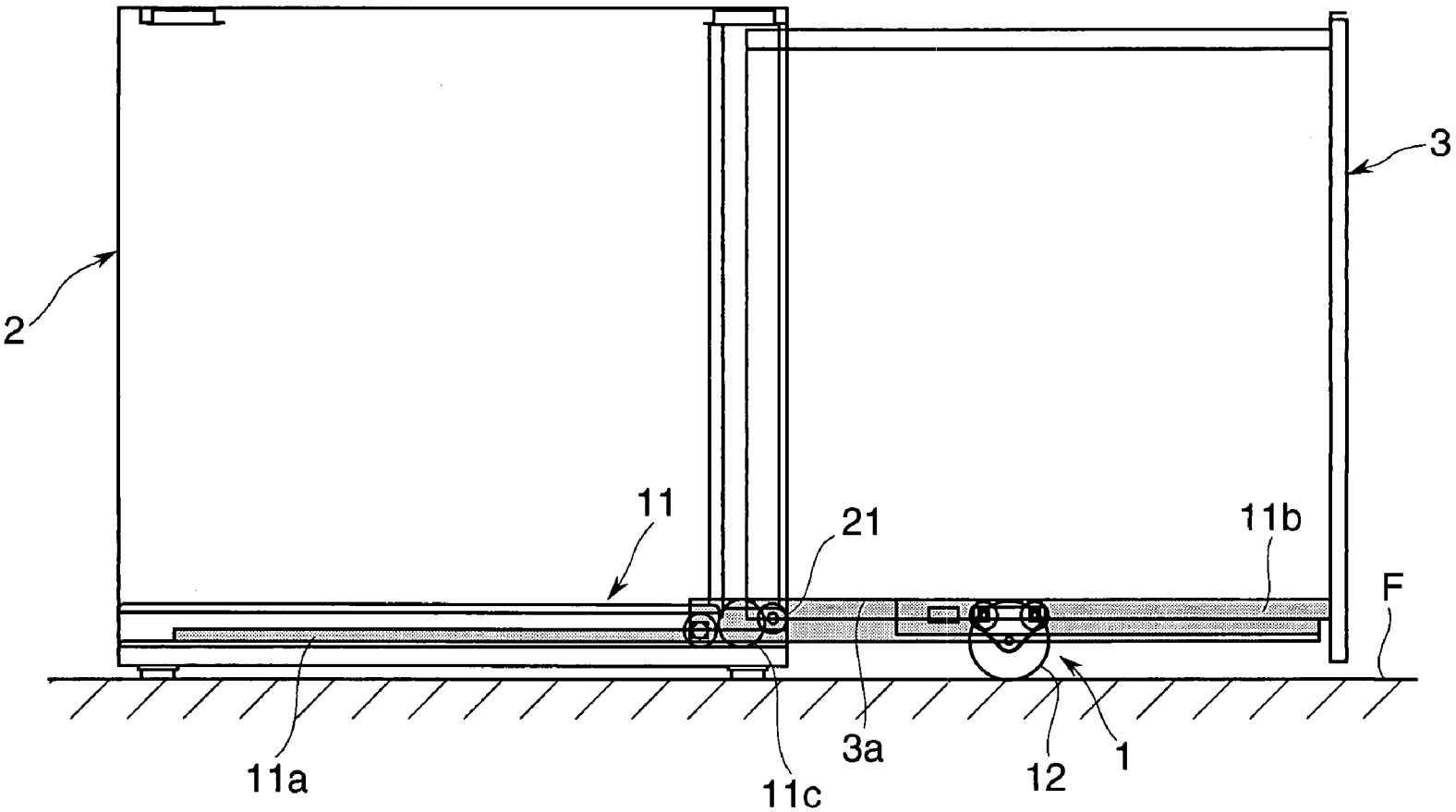
FIG. 4 is a pattern diagram showing the supporting arrangement of a drawer in accordance with the embodiment.

The free motion rotating body 12 moves only by half of a moving distance of the drawer 3 as shown in FIG. 2, FIG. 3 and FIG. 4 with an operation of drawing the drawer 3 from the stored position. More concretely, as shown in FIG. 6, if the free motion rotating body 12 makes a rolling movement from a first grounded position A1 on a circumference thereof by θ radian, the free motion rotating body 12 moves from a first grounded position B1 on the floor F by a distance of rθ. At this time, an upper end of the free motion rotating body 12 contacts the downward facing surface 3*a* of the drawer 3 and the drawer 3 is brought out by a distance of rθ. As a result, the drawer 3 is moved by a distance of 2rθ relative to the floor F. More specifically, the free motion rotating body 12 supports the drawer 3 with moving at a speed V/2 of half a traveling speed V of the drawer 3.

In cases where there is a relatively big friction between the free motion rotating body 12 and the floor F and the free motion rotating body 12 is urged to rotate against the frictional resistance f0, it is clear from a difference of a torque arm that it requires less force to roll the free motion rotating body 12 on the floor F if a frontward urging force f1 is applied to the upper end 12*b* of the free motion rotating body 12 from the downward facing surface 3*a* of the drawer 3 like this embodiment than, for example, a case where a frontward urging force f2 is applied to an axis (corresponding to an axis m in FIG. 5) of a wheel that is axially mounted on a bracket that travels at the same speed as that of the drawer 3. This is clear from a fact that a moving distance of the free motion rotating body 12 relative to the floor F whose frictional resistance f0 is big becomes generally half if the free motion rotating body 12 is adopted.

As a result, if the free motion rotating body 12 supports the bottom surface of the front end 3*b* of the drawer 3, it is possible to operate the drawer 3 with an extremely slight force compared with a conventional case, thereby improving usability of the drawer 3 and furthermore the desk A with the drawer.

Especially, since the free motion rotating body 12 directly contacts the downward facing surface 3*a* of the drawer 3 and the floor F, an arrangement and an assembling procedure of the free motion rotating body 12 can be extremely simplified just by arranging the free motion rotating body 12 between the drawer 3 and the floor F, thereby simplifying an operation so that a stable performance can be expected.

In addition, since the free motion rotating body 12 is supported by the drawer 3 through the rail 13 and the rotors 14 in a state of capable of being suspended, it is possible to keep the free motion rotating body 12 attached to the drawer 3 all the time in case of lifting to move the desk A or bringing in or out the desk A. Then there is no need of procedure of mounting or demounting the free motion rotating body 12 every time the desk A is moved, thereby to effectively avoid lowering usability.

Furthermore, since the width d of the free motion rotating body 12 is made to exceed one third of the width w of the drawer 3 and the free motion rotating body 12 is arranged at a generally middle portion along the width of the drawer 3, it is possible to open both sides of the free motion rotating body 12 in order to support rear end sides of the right and left side edges of the drawer 3 by the suspension rail mechanism 11 and also possible to decrease the frictional force due to an abutting contact locally with the floor F by broadening the area that contacts the floor F as much as possible.

Especially, if the drawer 3 is a large-scaled simplical body arranged all over the drawer storage portion 2 with somewhat small stiffness due to an opening formed on an upper portion of one side of the bottom wall 31 although the upper portion of the three sides of the bottom wall 31 is surrounded by the front wall 32, the rear wall 33 and the right side wall 34 like this embodiment, an excessive operational force applied to the drawer 3 might cause deformation of the drawer 3, however, in accordance with this embodiment, the operational force can be reduced by half, thereby producing an effect of enabling to draw in or out the drawer 3 without causing deformation as much as possible.

Each arrangement is not limited to the above-mentioned embodiment. For example, in cases where the drawer 3 is supported by the suspension rail mechanism 11 appropriately only at a time of initial motion of drawing out and hangs down due to its weight after the drawer 3 is drawn out by a certain degree so that the drawer 3 can not be supported appropriately by the suspension rail mechanism 11 alone, it is effective that a time when the free motion rotating body 12 makes an initial motion of rolling is delayed until the drawer 3 starts to hang down and after this time the front end side of the drawer 3 is supported to lift.

Figure 7:
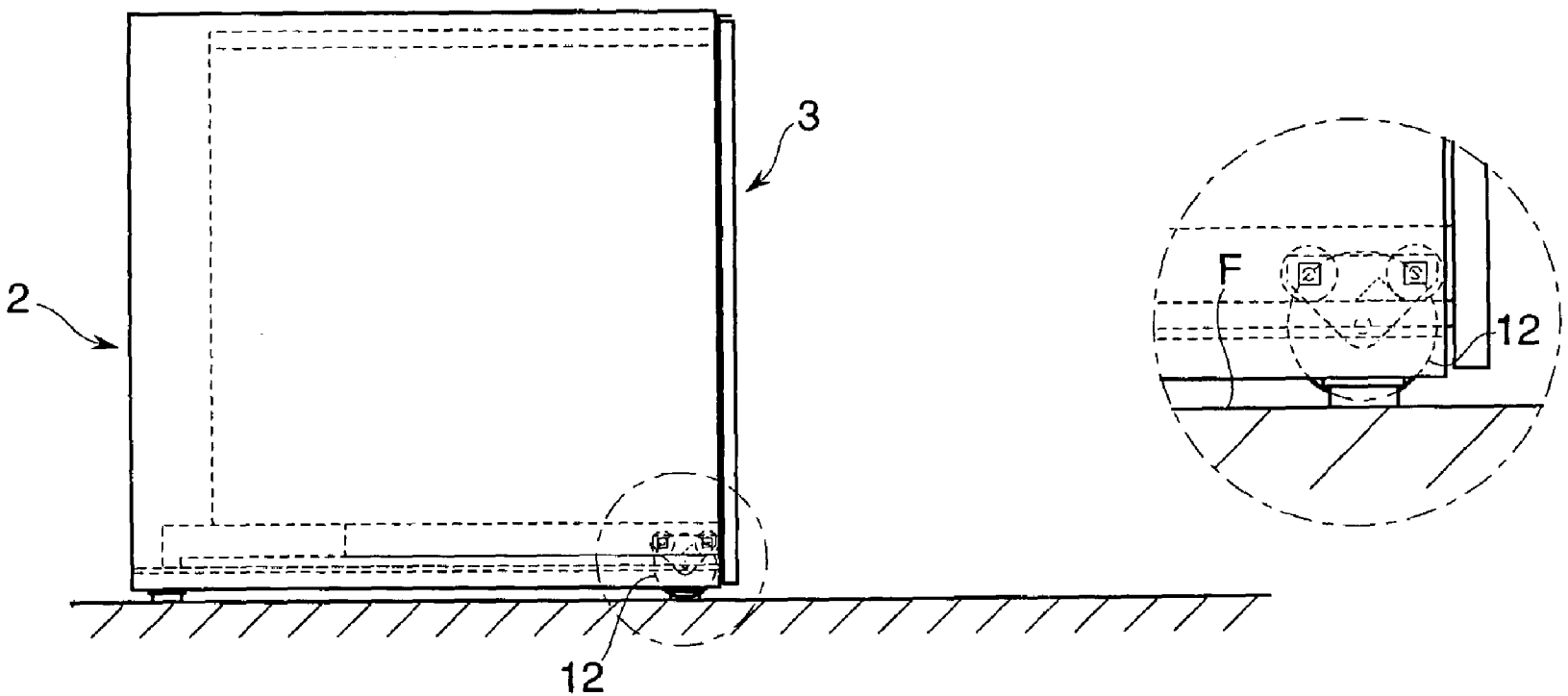
FIG. 7 is a view showing a modified form of the present claimed invention together with an operation.
Figure 8:
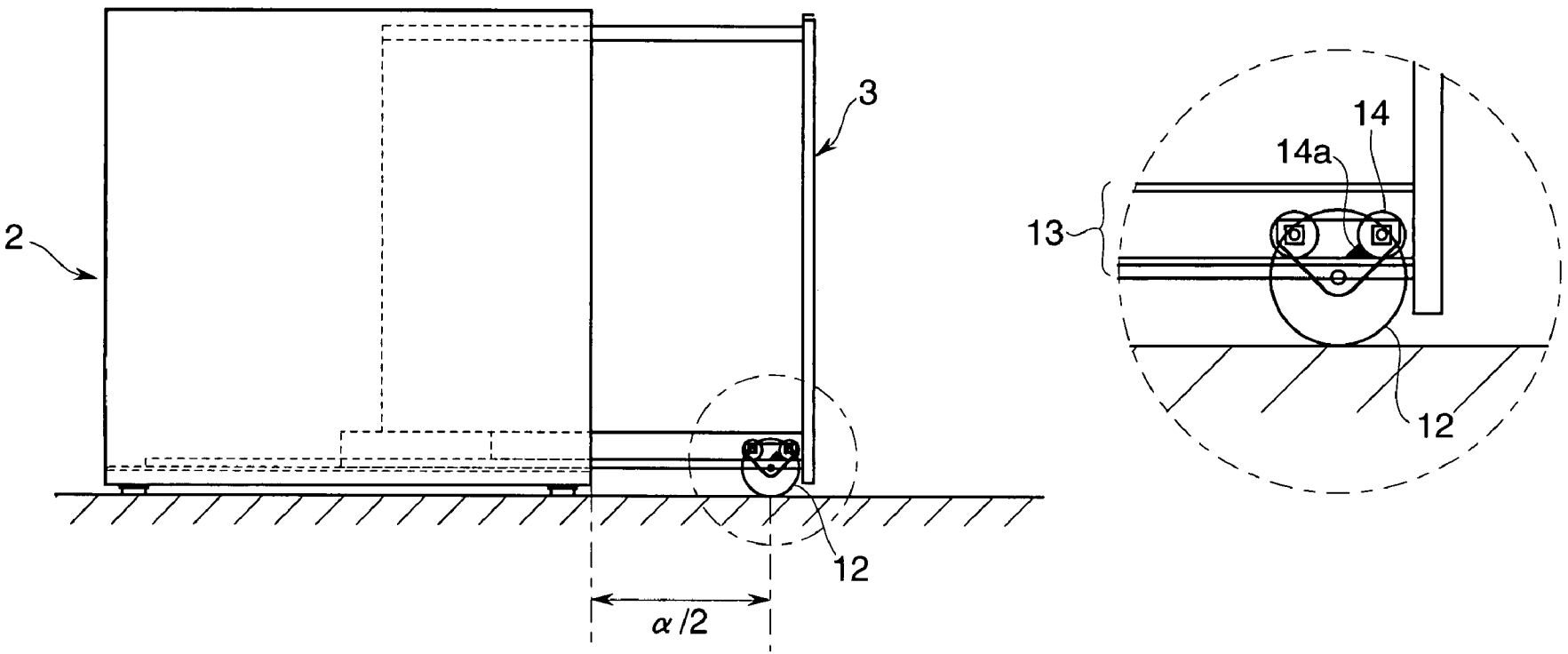
FIG. 8 is a view showing a modified form of the present claimed invention together with an operation.
Figure 9:
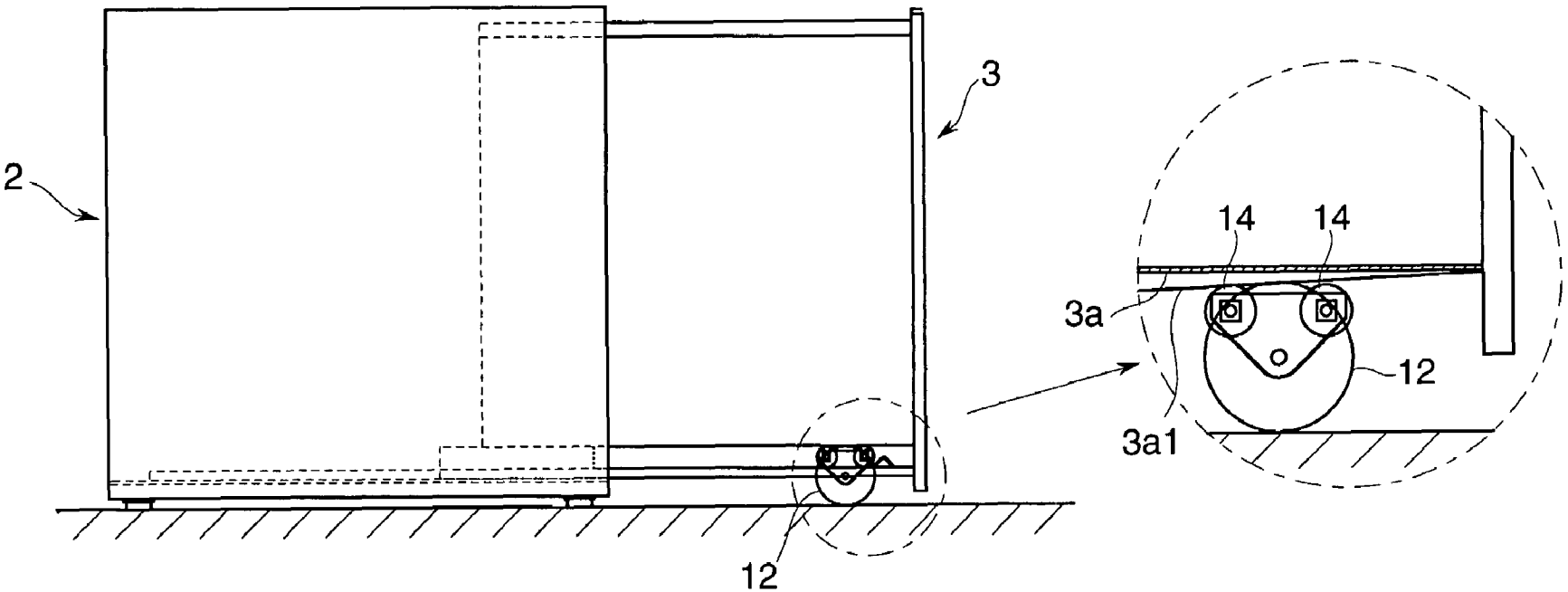
FIG. 9 is a view showing a modified form of the present claimed invention together with an operation.
Figure 10:
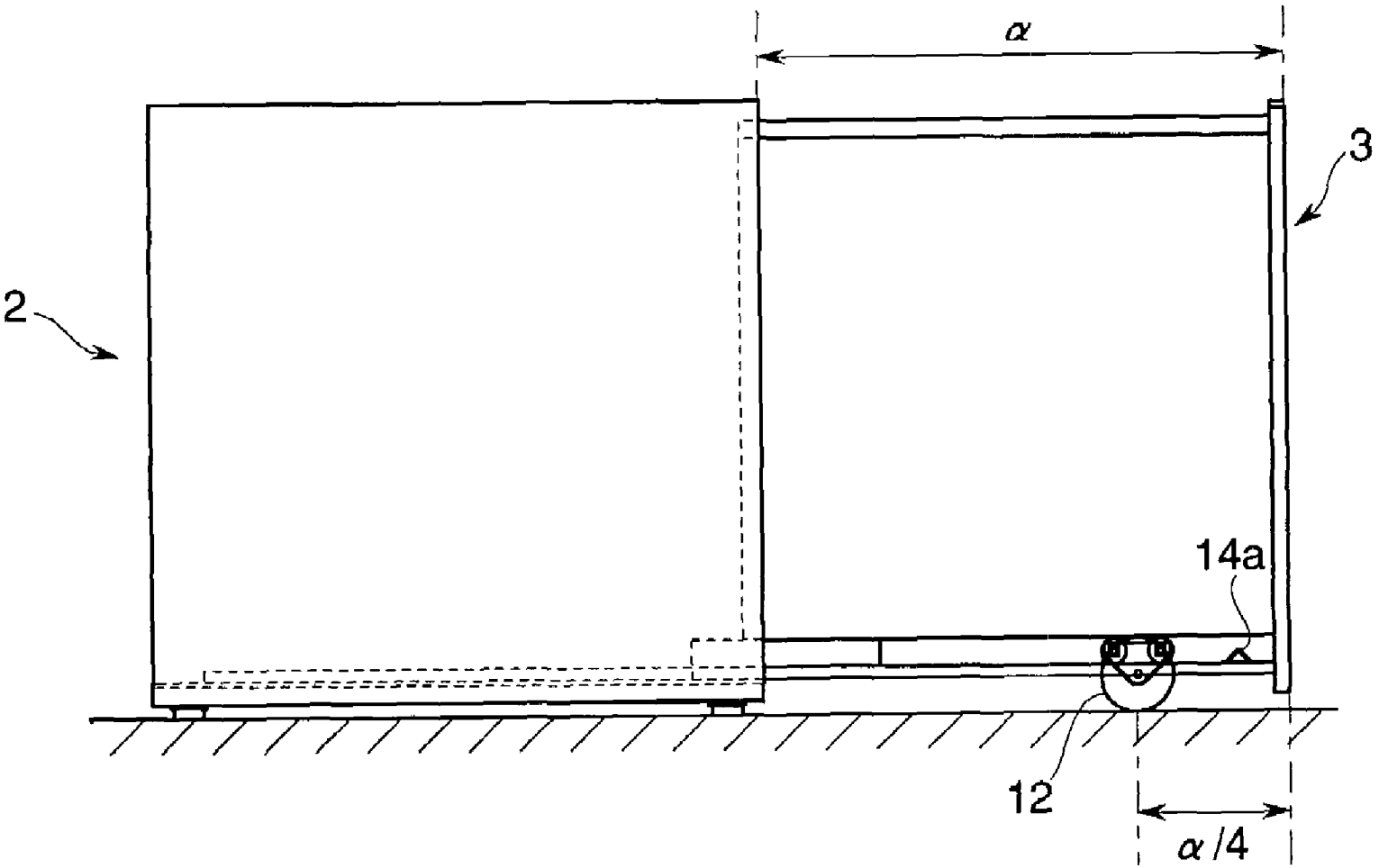
FIG. 10 is a view showing a modified form of the present claimed invention together with an operation.
Figure 11:
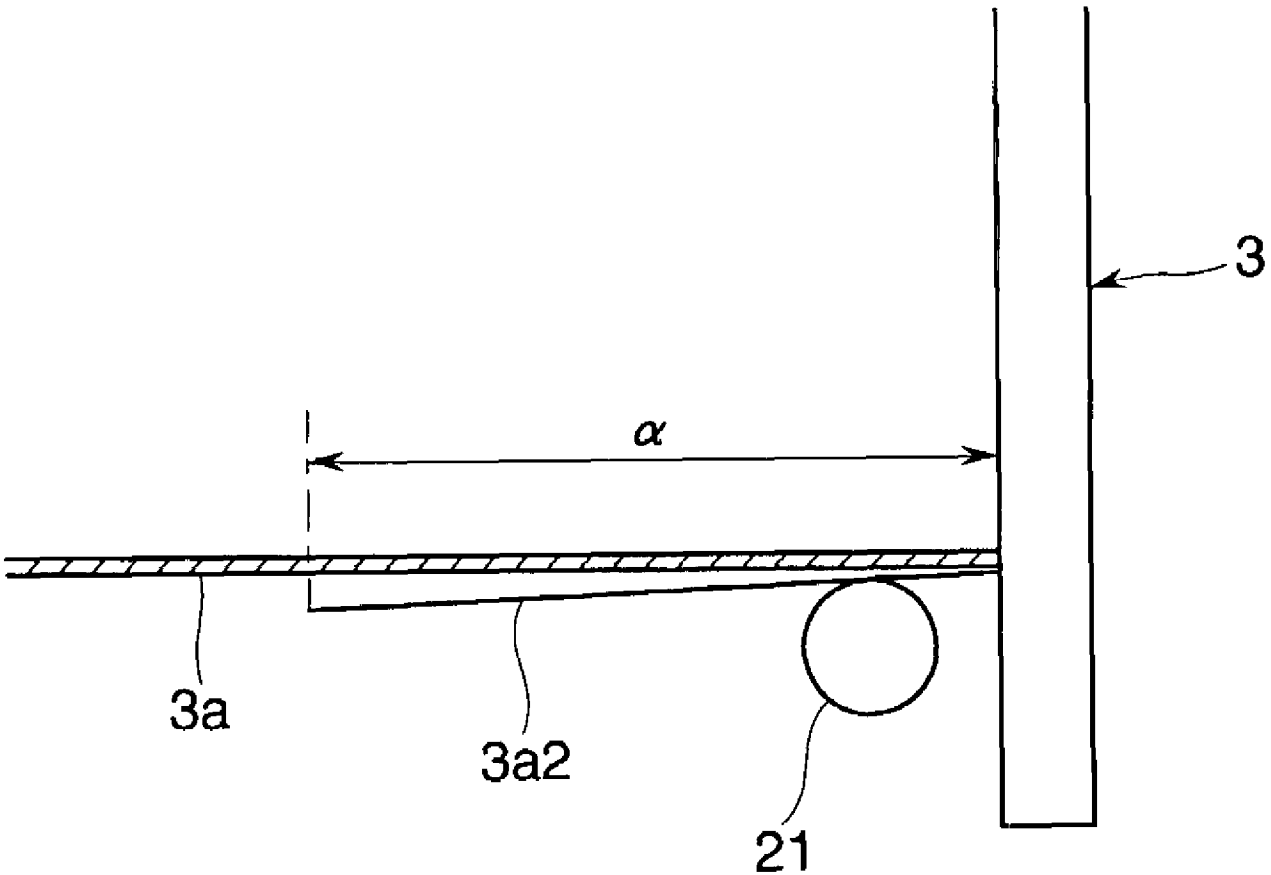
FIG. 11 is a view showing another modified form of the present claimed invention.

FIG. 7 through FIG. 10 show an example wherein the drawer 3 is drawn out from a state shown in FIG. 7, then the free motion rotating body 12 contacts the floor at a position where the drawer 3 is drawn out by generally half an amount $\alpha/2$ of a total moving amount $\alpha$ as shown in FIG. 8, the free motion rotating body 12 starts to make a rolling movement toward a direction as shown in FIG. 9 at the position shown in FIG. 8, and the free motion rotating body 12 is positioned at a position inside from the front end 3*b* of the drawer 3 by an amount of $\alpha/4$ when the drawer 3 is moved to open fully by an amount $\alpha/2$, one half of the remaining amount, as shown in FIG. 10.

More concretely, in order to prevent the drawer 3 from hanging down due to its weight when the drawer 3 is drawn out, the free motion rotating body 12 is supported at a portion floating from the floor F through the rail 13 and the rotor 14 shown in FIG. 6 at a time when the drawer 3 is initially moved. In this case, the rear end side of the drawer 3 is supported by the drawer storage portion 2 through the suspension rail mechanism 11. If an operation of drawing out the drawer 3 is further carried on, the drawer 3 starts to hang down due to its weight and the free motion rotating body 12 contacts the floor F. At this time, an inclined face 3*a*1 gradually approaching the floor F is arranged on the downward facing surface 3*a* of the drawer 3 as shown in FIG. 9 and the free motion rotating body 12 is arranged to get into under the inclined face 3*a*1 so as to lift the front end side of the drawer 3 at a time after the free motion rotating body 12 contacts the floor F.

If a stopper 14*a* is arranged at a part of the rail 13 to hold the rotor 14 tentatively at a front end portion of the rail 13 until the free motion rotating body 12 contacts the floor F as shown in FIG. 8, reliability of the above-mentioned behavior can be expected to increase.

In accordance with the arrangement, since the free motion rotating body 12 locates at a portion most suitable to support the drawer 3 when the drawer 3 is fully drawn, the drawer 3 can be prevented from overturning and the moving distance of the free motion rotating body 12 becomes small, thereby to effectively avoid a problem of requiring an excessive operational force.

In order to secure a floating state of the free motion rotating body 12, it is effective that an inclined face 3*a*2 is arranged between the drawer storage portion 2 and the downward facing surface 3*a* of the drawer 3 associated with the above-mentioned guide roller 21 to raise the free motion rotating body 12 above the floor F at a time when the drawer 3 is initially moved and to make the free motion rotating body 12 contact with the floor F after the drawer 3 reaches a predetermined position.

In the above-mentioned embodiment, the free motion rotating body contacts the downward facing surface of the object and the floor directly, however, the free motion rotating body may contact the downward facing surface and the floor indirectly through an endless track.

It is effective if the present claimed invention is also applied to a drawer arranged at the lowest part of the drawer storage portion in multiple drawers arranged up and down. In addition to this, it is possible to apply the present claimed invention to a broad range of cases wherein the box body is a drawer storage portion of store fixtures such as a wagon or the like equipped with a drawer or the object is not limited to a drawer.

The invention claimed is:

1. An object supporting unit comprising means whereby at least a rear end side of an object is supported in a box body in a horizontally-movable manner and a front end side of the object is supported in a manner movable back and forth along a floor at least through a rolling supporting body so as to allow the object to be drawn forward from a first stored position in the box body; wherein the rolling supporting body comprises a free motion rotating body having an upper end making an abutting contact with a downward facing surface of the object and a bottom end contacting the floor, and wherein the free motion rotating body, when in a second position, supports the front end side of the object by making a rolling movement; wherein in the first position the free motion rotating body is supported by the object in a manner moveably mounted through a rail and a rotor floating from the floor through the rail and the rotor at a time when the object is initially moved, and wherein the free motion rotating body, when in the second position, contacts, and moves underneath an inclined face arranged on the downward facing surface of the object so as to lift the front end side of the object at a time after the free motion rotating body contacts the floor to move the object; wherein the rail is directly connected to the downward facing surface of the object; wherein the rolling supporting body further comprises a bracket; wherein an axis is connected to the bracket and the axis supports the free motion rotating body; wherein the bracket is connected to the rotor and the rotor engages the rail.

2. The object supporting unit described in claim 1, wherein a stopper is arranged at a part of the rail to hold the rotor temporarily at a front end portion of the rail until the free motion rotating body contacts the floor.

3. The object supporting unit described in claim 1, wherein a width of the free motion rotating body exceeds one third of a width of the object and the free motion rotating body is arranged at a position supporting a middle portion along the width of the object.

4. The object supporting unit described in claim 1, wherein the object is a drawer and the box body is a drawer storage portion of a desk.

5. The object supporting unit described in claim 4, wherein the drawer is arranged at the lowest part of the drawer storage portion or the drawer is arranged over the entire drawer storage portion.

6. The object supporting unit described in claim 5, wherein the drawer comprises a bottom wall and three standing side walls wherein one standing side wall is orthogonal to a direction accessible to an article to be stored is open.

7. The object supporting unit described in claim 5 wherein the free motion rotating body travels a linear distance along the floor at half traveling speed of the drawer traveling a linear distance along the floor.

8. The object supporting unit described in claim 4, wherein the drawer comprises a bottom wall and three standing side walls wherein one standing side wall is orthogonal to a direction accessible to an article to be stored is open.

* * * * *